US005930568A

United States Patent [19]

Ito et al.

[11] Patent Number: 5,930,568

[45] Date of Patent: Jul. 27, 1999

[54] ELECTROPHOTOGRAPHIC IMAGE FORMING APPARATUS

[75] Inventors: Katsuyuki Ito; Toshiro Murano, both of Tokyo, Japan

[73] Assignee: Oki Data Corporation, Tokyo, Japan

[21] Appl. No.: 08/965,409

[22] Filed: Nov. 6, 1997

[30] Foreign Application Priority Data

Nov. 14, 1996 [JP] Japan ..... 8-302887

[51] Int. Cl.[6] ..... G03G 15/08

[52] U.S. Cl. ..... 399/252; 347/131

[58] Field of Search ..... 347/131, 239; 399/252

[56] References Cited

U.S. PATENT DOCUMENTS

| | | | |
|---|---|---|---|
| 4,060,323 | 11/1977 | Hirayama et al. | 347/239 X |
| 4,361,394 | 11/1982 | Sakai et al. | 347/131 |
| 5,268,709 | 12/1993 | Saito et al. | 347/131 |

FOREIGN PATENT DOCUMENTS

| | | |
|---|---|---|
| 0 330 498 | 8/1989 | European Pat. Off. . |
| 0 712 048A1 | 5/1996 | European Pat. Off. . |
| 7-295320 | 11/1995 | Japan . |
| 8-00606390 | 1/1996 | Japan . |

*Primary Examiner*—Fred L. Braun
*Attorney, Agent, or Firm*—Rabin & Champagne, P.C.

[57] ABSTRACT

An electrophotographic image forming apparatus has a photosensitive drum; a charging device for charging a surface of the photosensitive drum; an LED array for projecting a light beam on the surface of the photosensitive drum, thereby forming irradiated spots constituting an electrostatic latent image. The irradiated spots are formed on intersections of a grid which is composed of a plurality of first lines extending in a main-scanning direction and arranged at equal first intervals and a plurality of second lines extending in a sub-scanning direction and arranged at equal second intervals. The apparatus also has a developing device for attaching a toner particle extending to each of the irradiated spots, a transfer device for transferring the toner particle to a transfer material, and a fixing device for fixing the toner particle on the transfer material. A diameter of the toner particle is determined in such a way that a diameter of a fixed toner particle is equal to approximately a length of a diagonal line of the grid. Further, the diameter of the toner particle in the developing device is in a range of 0.7 times to 1.0 times as long as the first interval and/or the second interval.

7 Claims, 3 Drawing Sheets

ELECTROPHOTOGRAPHIC IMAGE FORMING APPARATUS

BACKGROUND OF THE INVENTION

The present invention relates to an electrophotographic image forming apparatus such as an electrophotographic printer, and in particular, to a diameter of a toner particle.

In conventional electrophotographic printers, in general, after an electrostatic latent image is formed on the surface of a photosensitive drum by means of a laser scanner, an LED head or the like, toner particles are attached to the electrostatic latent image in a developing section to form a toner image on the surface of the photosensitive drum. Then, the toner image is transferred onto paper as a transfer material in a transfer section.

The paper is then fed to a fixing device, and the toner image is fixed on the paper by the fixing device.

The average diameter of the toner particles is in a range of 5 [μm] to 15 [μm] and varies within the range of approximately 10 [μm]. The resolution of the electrophotographic printer is determined to be 300 [dpi] or 600 [dpi] in terms of the laser scanner, the LED head or the like, and an electrostatic latent image is to be formed with the resolution of 300 [dpi] or 600 [dpi].

In this case, at least ten toner particles are to be attached to each of irradiated spots constituting the electrostatic latent image during the development.

In the conventional electrophotographic printers, in order to increase the resolution, it is necessary to use the toner having a small particle diameter. Nevertheless, if the toner with a small particle diameter is used, the ratio of the toner particles transferred onto the paper by the transfer process to all the toner particles constituting the toner image the surface of the photosensitive drum, that is, a transfer efficiency, will be reduced.

This happens because, since the toner particles with a smaller diameter are readily subject to the Van der Waals force when attached to the electrostatic latent image on the surface of the photosensitive drum, the sufficient amount of the toner particles on the surface of the photosensitive drum can not be attracted to the paper by the electrostatic forces in the transfer section.

Further, in order to have a sufficiently high print density of the toner image, it is necessary to render the thickness of a toner layer on the developing roller about twice as large as the diameter of the toner particle. However, when the toner particles with a small diameter are used, it is difficult to render the thickness of the toner layer uniform, leading to unevenness of the toner image.

Furthermore, in order to increase the resolution of the electrophotographic printer to 1200 [dpi], for example, it is necessary to use the toner particles with a diameter of not more than 5 [μm]. However, such toner particles tend to float in the air, thus resulting in the pollution of the environment.

SUMMARY OF THE INVENTION

It is therefore an object of the present invention to provide an electrophotographic image forming apparatus capable of maintaining high resolution without reducing transfer efficiency, preventing unevenness of the toner image, and preventing pollution of environment.

According to one aspect of the present invention, an electrophotographic image forming apparatus has: an image carrier; a charging device for charging a surface of the image carrier; and a light beam scanner for projecting a light beam on the surface of the image carrier, thereby forming irradiated spots constituting an electrostatic latent image on the surface of the image carrier. The irradiated spots are formed on intersections of a grid which is composed of a plurality of first lines extending on the surface of the image carrier in a main-scanning direction and arranged at equal first intervals and a plurality of second lines extending on the surface of the image carrier in a sub-scanning direction perpendicular to the main-scanning direction and arranged at equal second intervals. The apparatus also has a developing device for attaching a toner particle extending to each of the irradiated spots on the surface of the image carrier to form a toner image on the surface of the image carrier; a transfer device for transferring the toner particle to a transfer material; and a fixing device for fixing the toner particle on the transfer material. The developing device contains the toner particles, each diameter of which is determined in such a way that each diameter of fixed toner particles is equal to approximately a length of a diagonal line of the grid.

Further, the each diameter of the toner particles in the developing device is in a range of 0.7 times to 1.0 times as long as the first interval and/or the second interval.

According to another aspect of the present invention, a method for electrophotographically forming an image comprising the steps of: charging a surface of a image carrier; projecting a light beam on the surface of the image carrier, thereby forming irradiated spots constituting an electrostatic latent image on the surface of the image carrier, the irradiated spot being formed on intersections of a grid which is composed of a plurality of first lines extending on the surface of the image carrier in a main-scanning direction and arranged at equal first intervals and a plurality of second lines extending on the surface of the image carrier in a sub-scanning direction perpendicular to the main-scanning direction and arranged at equal second intervals; attaching a toner particle to the irradiated spot on the surface of the image carrier; transferring the toner particle to a transfer material; and fixing the toner particle on the transfer material. A diameter of the toner particle is determined in such a way that a diameter of a fixed toner particle is equal to approximately a length of a diagonal line of the grid.

Further, the diameter of the toner particle before the fixing step is in a range of 0.7 times to 1.0 times as long as the first interval and/or the second interval.

BRIEF EXPLANATION OF THE DRAWINGS

The present invention will become more fully understood from the detailed description given hereinbelow and the accompanying drawings which are given by way of illustration only, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

Figure 1:
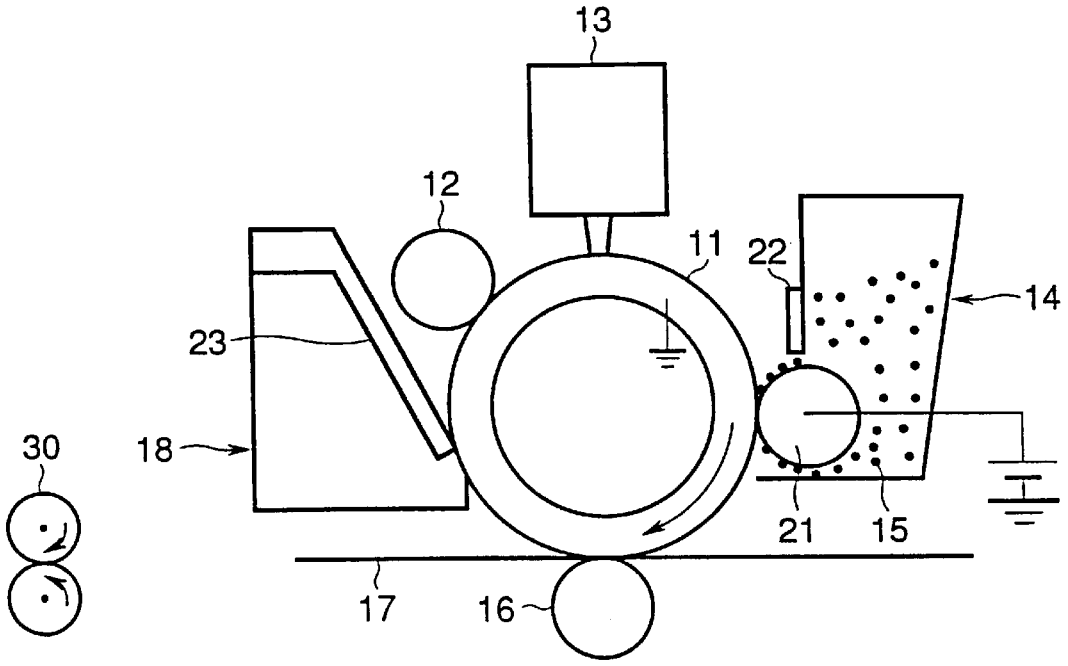
FIG. 1 is a schematic diagram showing an electrophotographic printer according to an embodiment of the present invention.

FIG. 1 is a schematic diagram showing an electrophotographic printer as an electrophotographic image forming apparatus according to the embodiment of the present invention.

Referring to FIG. 1, the electrophotographic printer of this embodiment has a photosensitive drum 11 as an image carrier which is rotated at a constant peripheral speed in an arrow direction by a drive mechanism (not shown in the figure), a charging roller 12 as a charging device, an LED head 13 as a light beam scanner, a developing device 14 having a developing roller 21, a transfer roller 16 as a transfer device for transferring a toner image to paper 17 as a transfer material, and a clearing device 18. The charging roller 12, the LED head 13, the developing device 14, the transfer roller 16 and the clearing device 18 are disposed so as to face the photosensitive drum 11 from the upstream to the downstream in the rotating direction of the photosensitive drum 11, respectively. A developing section is formed between the photosensitive drum 11 and the developing roller 21 in the developing device 14, and a transfer section is formed between the photosensitive drum 11 and the transfer roller 16. Further, the electrophotographic printer of this embodiment has a fixing device 30 for heating and pressing the toner particles on the paper 17, thereby fixing the toner image on the paper 17.

In this electrophotographic printer, by applying a high voltage to the charging roller 12, the surface of the photosensitive drum 11 is charged uniformly. The LED head 13 applies light beams on the surface of the photosensitive drum 11, that is, performs optical writing on the surface of the photosensitive drum 11, thereby forming a plurality of irradiated spots constituting an electrostatic latent image.

The developing device 14 then performs development by attaching toner particles 15 to the electrostatic latent image on the photosensitive drum 11 to form the toner image. In order to do so, a development blade 22 is disposed so as to face the developing roller 21, and by means of the development blade 22, the toner particles 15 on the developing roller 21 are formed into a thin toner layer. The peripheral speed of the photosensitive drum 11 is set to be substantially the same as that of the developing roller 21. In this embodiment, a one-component nonmagnetic developer is used as the developing device 14.

Then, with the rotation of the photosensitive drum 11, the toner image is moved to the transfer section, and the toner image is transferred onto the paper 17 by the transfer roller 16. For this purpose, a semiconductive sponge roller or the like is used as the transfer roller 16 and brought into contact with the photosensitive drum 11. In addition, the peripheral speed of the photosensitive drum 11 is set to be substantially the same as that of the transfer roller 16. A voltage for the transfer is applied to the transfer roller 16 so as to attract the individual toner particles 15 constituting the toner image.

Thereafter, the paper 17 is fed to the fixing device 30, and the toner particles are fixed to the paper 17 by the fixing device 30. On the other hand, some toner particles 15 remain on the surface of the photosensitive drum 11 after the transfer, but are removed by the cleaning device 18, which is provided with a cleaning blade 23 being brought into contact with the photosensitive drum 11.

In order to increase the resolution of the electrophotographic printer having the above-mentioned structures, it is necessary to use the toner particles 15 having a small diameter. However, if the toner particles with a small diameter are used, the transfer efficiency will be reduced for the reasons described above.

Further, in order to obtain a sufficiently high print density, it is necessary to make the thickness of the toner layer on the developing roller 21 about twice as large as the diameter of the toner particle 15. However, when the toner particles 15 having a small diameter are used, it is difficult to render the thickness of the toner layer uniform.

Further, in order to increase the resolution of the electrophotographic printer to 1200 [dpi], for example, it is necessary to use the toner particles 15 having a diameter of not more than 5 [$\mu$m]. However, the toner particles 15 having the diameter of not more than 5 [$\mu$m] tend to float in the air, thus resulting in pollution of environment.

When a pitch of a grid (i.e., an interval of adjacent lines of a grid) set on the photosensitive drum 11 is represented by p, diameters of irradiated spots formed by the LED head 13 and constituting the electrostatic latent image is represented by d1, a diameter of a toner particle is represented by d2, the diameter d1 of the irradiated spot is set to 0.7 p–1.4 p, and the diameter d2 of the toner particle is set to 0.7 p–1.0 p.

Figure 2:
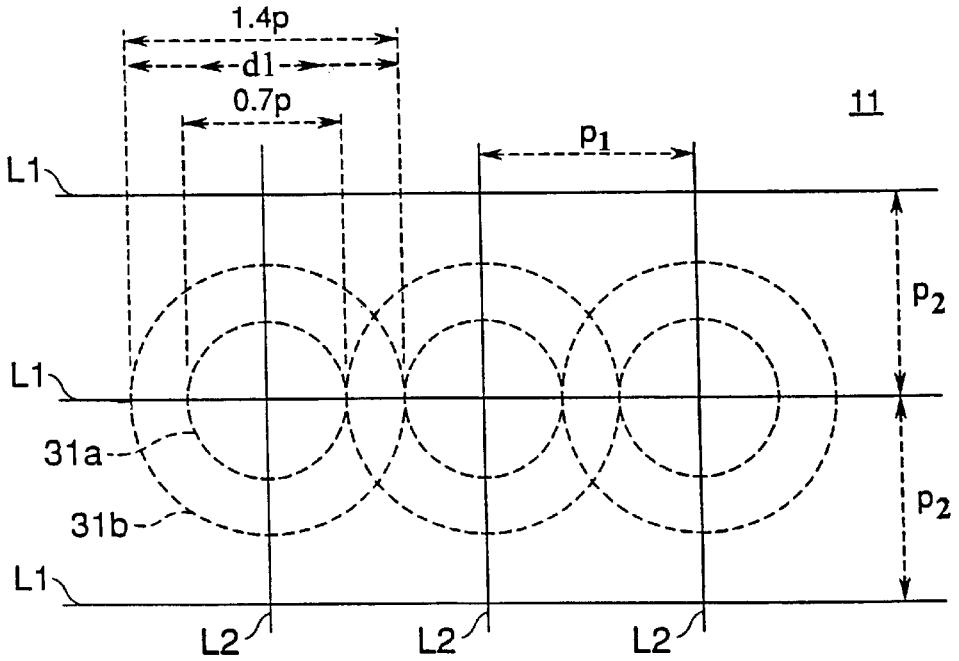
FIG. 2 is a diagram showing a relationship between a diameter of an irradiated spot and resolution of an electrophotographic printer according to the embodiment.

FIG. 2 is a diagram showing a relationship between the diameter of irradiated spots and the resolution of the electrophotographic printer of this embodiment.

Referring to FIG. 2, a plurality of lines set on the photosensitive drum 11 and extending in a scanning direction (i.e., a main-scanning direction) are denoted by L1, and a plurality of lines set on the photosensitive drum 11 and extending in a paper-feed direction (i.e., a sub-scanning direction) are denoted by L2. The lines L1 and L2 are imaginary ones, and constitute a grid which is an imaginary one for purpose of explaining irradiated positions on the photosensitive drum 11 and positions on the paper 17 corresponding to the irradiated positions on the photosensitive drum 11. The lines L1 and L2 are arranged, being spaced apart by the pitch (or interval) p which is determined on the basis of the resolution of the electrophotographic printer. In FIG. 2, the first pitch p1 in the main-scanning direction (the direction along the line L1) and the second pitch p2 in the sub-scanning direction (the direction along the line L2) have the same value p. However, the present invention can be applied to the apparatus in which the first pitch p1 and the second pitch p2 are different.

When a light beam is projected onto the intersections of the lines L1 and L2 by the LED head 13 to perform the optical writing on the surface of the photosensitive drum 11, the irradiated spots with the diameter d1 set to 0.7 p–1.4 p are formed, and an electrostatic latent image is formed by the irradiated spots. In FIG. 2, a reference numeral 31*a* denotes an irradiated spot with the diameter d1 of 0.7 p, and a reference numeral 31*b* denotes an irradiated spot with the diameter d1 of 1.4 p. The diameter d1 can be set to any value by adjusting the sensitivity of the photosensitive drum 11 and intensity of light beam emitted from the LED array 13.

Figure 3:
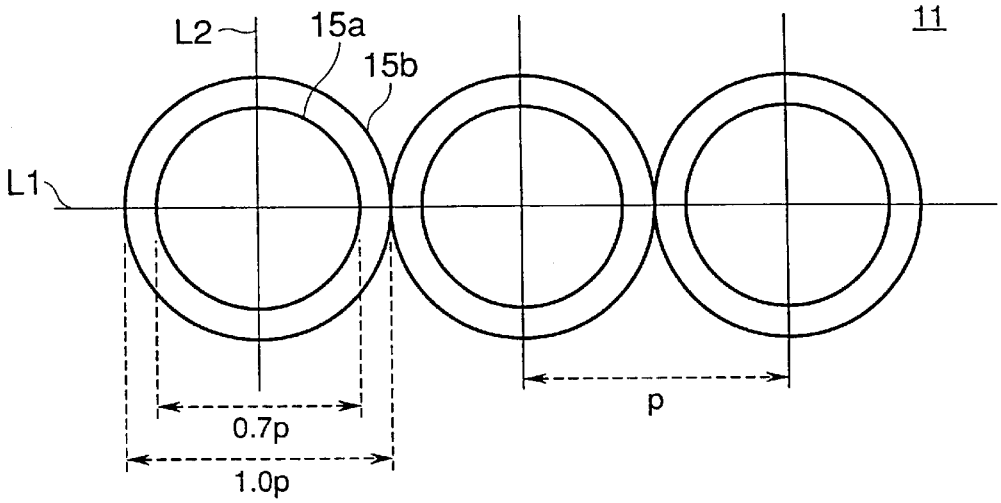
FIG. 3 is a diagram showing a relationship between a diameter of toner particles and resolution of the electrophotographic printer according to the embodiment.

Then, a toner particle 15 with the diameter d2 set to 0.7 p–1.0 p is attached to each of the irradiated spots by the developing device 14 to form a toner image. FIG. 3 is a diagram showing a relationship between the diameter of the toner particle and the resolution of the electrophotographic printer of this embodiment. In FIG. 3, a reference numeral 15*a* denotes a toner particle having a diameter d2 of 0.7 p, a reference numeral 15*b* denotes a toner particle having a diameter d2 of 1.0 p. In this embodiment, the toner particles 15 (15*a* or 15*b* in FIG. 3) as spherical particles are used.

Figure 4:
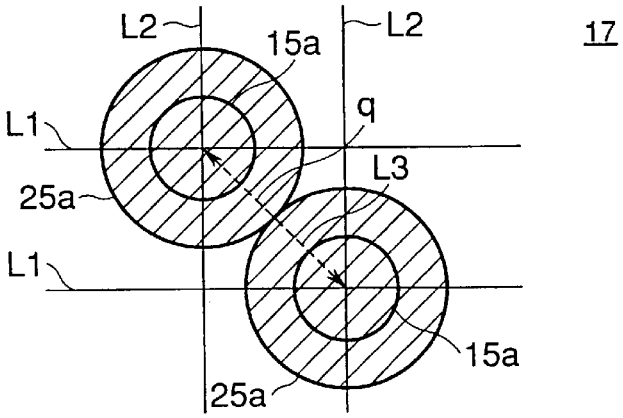
FIG. 4 is a diagram showing a change in the toner caused by the fixing device according to the embodiment.

FIG. 4 is a diagram showing a change in the toner particle caused by the fixing device according to this embodiment. Referring to FIG. 4, when a distance between the intersections on a diagonal line L3 in the grid is represented by q, the distance q is expressed as follows:

$$q=[(p1)^2+(p2)^2]^{1/2}$$

When p1=p2=p, $$q=(2\times p^2)^{1/2}\approx 1.4p$$

When the toner particles 15 are fixed on the paper 17 by the fixing device 30, the individual toner particles 15 constituting the toner image are melted and become flat after being pressed against the paper 17, so that their diameters become about twice as large as the diameter of the toner particle 15 before the fixing process. Since the diameter d2 of the toner particle 15 is set to 0.7 p–1.0 p in this embodiment as described above, the diameter of the fixed toner particle becomes 1.4 p–2.0 p.

Incidentally, in general, the diameter of the fixed toner particle becoming about 1.2–2.0 times as large as the diameter d2 of the toner particle depends on conditions such as temperature and pressure at the fixing process. In the present invention, a lowest limit of the diameter of the toner particle before the fixing process is equal to or more than a value which is determined in such a way that the toner particles neighboring in a diagonal direction are in contact with each other. On the other hand, highest limit of the toner particle before the fixing process is 1.0 p.

It means that, even if the toner particle 15*a* having the diameter d2 of 0.7 p is used, as shown in FIG. 3, the diameter of the fixed toner particle 25*a* becomes 1.4 p, as shown in FIG. 4. Accordingly, the toner particles are connected not only on the lines L1 and L2 but also on the diagonal lines L3, as shown in FIG. 4. As a result, the fixed toner image can be prevented from being discontinuous, so that the image quality can be improved.

Figure 5:
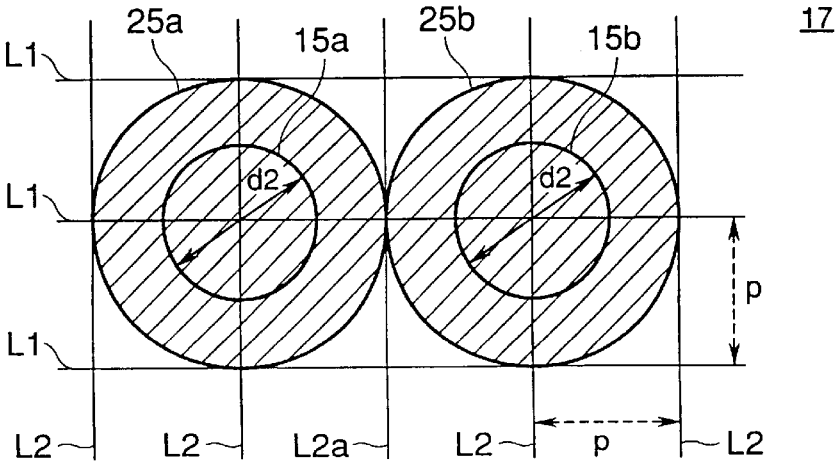
FIG. 5 is a diagram showing the toner particles transferred on the paper and the toner particles fixed on the paper, when the diameter of the toner particles is larger than a pitch of a grid.

FIG. 5 is a diagram showing the toner particles 15*a* and 15*b* transferred on the paper 17 and the toner particles 25*a* and 25*b* fixed on the paper 17, when the diameter d2 of the toner particles 15*a* and 15*b* is larger than 1.0 p. In this case, the fixed toner particles 25*a* and 25*b* extends over the neighboring lines, for example, the line L2*a*, on which no image should be formed or a white line is formed, thereby degrading the image quality.

Figure 6:
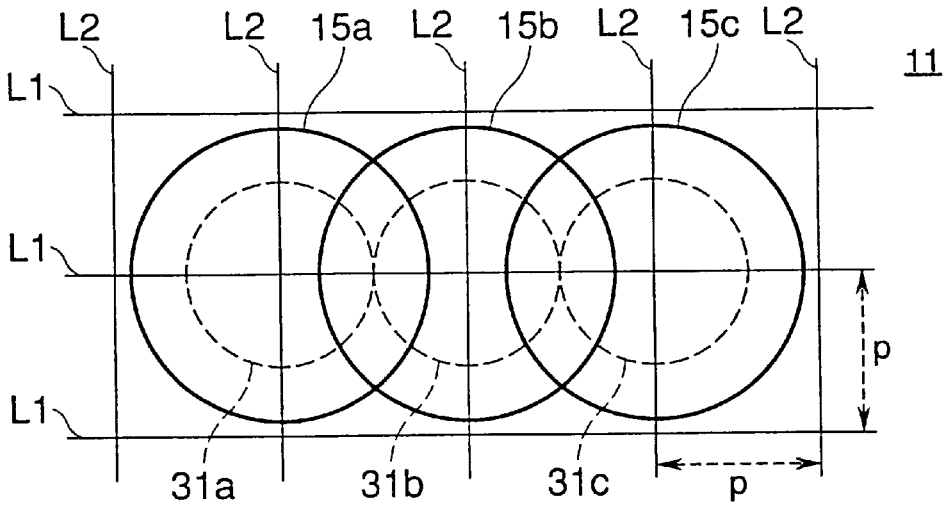
FIG. 6 is a diagram showing irradiated spots and toner particles on the surface of the photosensitive drum.

FIG. 6 is a diagram showing irradiated spots 31*a*, 31*b* and 31*c* and toner particles 15*a*, 15*b* and 15*c* on the surface of the photosensitive drum 11. Referring to FIG. 6, since the toner particles 15*a*, 15*b* and 15*c* overlap each other, they are easy to shift from the intersections of the lines L1 and L2. As a result, the large amount of toner particles are transferred and fixed on the positions shifted from the intersections of the lines L1 and L2, thereby degrading the image quality.

Figure 7:
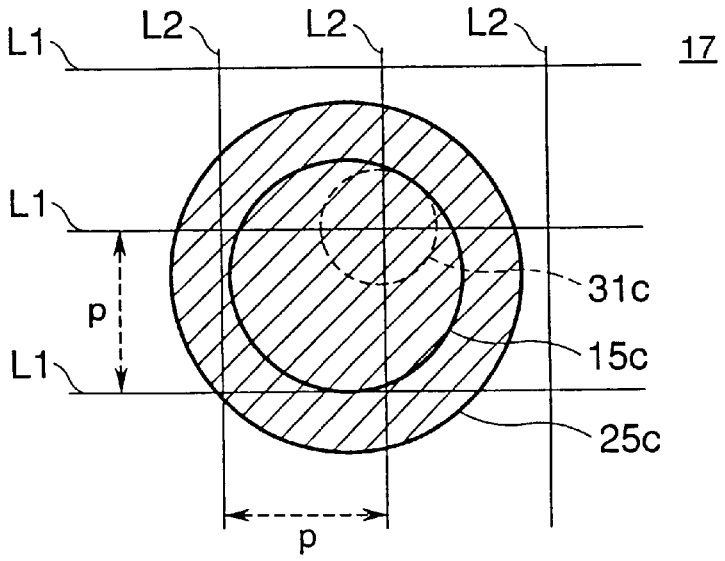
FIG. 7 is a diagram showing a change in the toner particle caused by the fixing device when the toner having the particle diameter being larger than the pitch of a grid is used.

FIG. 7 is a diagram showing a change in the toner particle caused by the fixing device when the toner particles having the diameter being larger than the pitch of the grid is used.

Referring to FIG. 7, a plurality of lines set on the photosensitive drum 11 (in FIG. 2) and extending in the main-scanning direction are denoted by L1, and a plurality of lines set on the photosensitive drum 11 and extending in the paper-feed direction (sub-scanning direction) are denoted by L2. The lines L1 and L2 constitute the grid. Further, the lines L1 and L2 are arranged, being spaced apart by the pitch p which is determined by the resolution of the electrophotographic printer.

A reference numeral 31*c* denotes an irradiated spot, a reference numeral 15*c* denotes toner attached to the irradiated spot 31*c*, and a reference numeral 25*c* denotes toner after the fixing process. In this case, the diameter d2 of the toner particle 15*c* is set to be larger than the diameter d1 of the irradiated spot 31*c*.

As seen from FIG. 7, when the toner particle 15*c* having the diameter d2 being larger than the diameter d1 of the irradiated spot 31*c* is used, the toner particle 15*c* can not be attached to the irradiated spot 31*c* precisely by the developing device 14.

As a result, the toner particle 25*c* after the fixing will be positioned, being greatly deviated from the location corresponding to the irradiated spot 31*c*, thus degrading the image quality. For this reason, the diameter d2 of the toner particle 15 is set to be smaller than 1.0 p, as described before.

If the toner particles 15 are prepared by polymerization, variations in the diameters d2 of 90% of the toner particles 15 can be made to fall within the range of approximately 5 [μm]. Thus, by means of polymerization, at least 90% of the whole toner particles contained in the fixing device can be easily made to have the diameter d2 of 0.7 p–1.0 p.

If the resolution of the electrophotographic printer is set to 1200 [dpi], the pitch set on the photosensitive drum 11 becomes approximately 21 [μm], and the diameter d2 of the toner particle 15 is set to approximately 15 [μm]–21 [μm]. Thus, the diameter of the toner particle can be made to be larger than that of the toner particle conventionally used. For this reason, when the toner particle 15 is formed into the thin toner layer on the developing roller 21 so as to obtain a sufficiently high print density, it is not necessary to make the thickness of the toner layer about twice as large as the particle diameter d2, so that the toner layer can be made to be a single layer. As a result, a uniform toner layer can be formed on the developing roller 21.

In addition, since the diameter d2 of the toner particle 15 is large, not only the transfer efficiency can be increased, but also the cleaning capability of the cleaning device 18 can be improved.

Moreover, since the diameter d2 of the toner particle 15 is large, the toner particles 15 is inhibited from floating in the air, and the environment can be thereby prevented from being polluted.

Furthermore, the present invention is not limited to the above-mentioned embodiment. Various variations are possible without departing from the spirit of the invention, and these are not to be excluded from the scope of the invention.

What is claimed is:

1. An electrophotographic image forming apparatus comprising:

an image carrier;

a charging device for charging a surface of said image carrier;

a light beam scanner for projecting a light beam on the surface of said image carrier, thereby forming irradiated spots constituting an electrostatic latent image on the surface of said image carrier, said irradiated spots being formed on intersections of a grid which is composed of a plurality of first imaginary lines extending on the surface of said image carrier in a main-scanning direction and arranged at equal first intervals and a plurality of second imaginary lines extending on the surface of said image carrier in a sub-scanning direction perpendicular to the main-scanning direction and arranged at equal second intervals;

a developing device for attaching a toner particle to each of the irradiated spots on the surface of said image carrier to form a toner image on the surface of said image carrier;

a transfer device for transferring the toner particle to a transfer material; and a fixing device for fixing the toner particle on the transfer material;

wherein said developing device contains the toner particles, a diameter of each of the toner particles in said developing device being determined in such a way that a diameter of a fixed toner particle which has been fixed on the transfer material by said fixing device is equal to approximately a length of a diagonal imaginary line joining two diametrically disposed intersections of the grid.

2. An electrophotographic image forming apparatus of claim 1, wherein the diameter of each of the toner particles in said developing device is in a range of 0.7 times to 1.0 times as long as the first interval.

3. An electrophotographic image forming apparatus of claim 2, wherein the diameter of each of the toner particles in said developing device is in a range of 0.7 times to 1.0 times as long as the second interval.

4. An electrophotographic image forming apparatus of claim 1, wherein the diameter of each of the toner particles in said developing device is in a range of 0.7 times to 1.0 times as long as the second interval.

5. An electrophotographic image forming apparatus of claim 1, wherein a relative ratio of the toner particles having diameters, which are determined in such a way that the diameter of each of the fixed toner particles is equal to approximately the length of the diagonal line of the grid, to all of the toner particles in said developing device, is not less than 90%.

6. An electrophotographic image forming apparatus of claim 1, wherein the diameter of the fixed toner particle is in a range of 1.2 times to 2.0 times as large as a diameter of the toner particle before fixing.

7. An electrophotographic image forming apparatus of claim 1, wherein the length (q) of the diagonal line is determined in accordance with the formula: $q=[(p\mathbf{1})^2+(p\mathbf{2})^2]^{1/2}$ wherein p1 is equal to a distance of the first interval, and p2 is equal to a distance of the second interval.

* * * * *